US006941896B1

(12) United States Patent
Morin

(10) Patent No.: US 6,941,896 B1
(45) Date of Patent: Sep. 13, 2005

(54) ANIMAL FECES COLLECTION DEVICE

(76) Inventor: Stephane Morin, 2845 Belanger Estate, Montreal, Quebec (CA) H1Y 1A8

( * ) Notice: Subject to any disclaimer, the term of this patent is extended or adjusted under 35 U.S.C. 154(b) by 0 days.

(21) Appl. No.: 10/947,502

(22) Filed: Sep. 23, 2004

(51) Int. Cl.[7] ..... A01K 1/01
(52) U.S. Cl. ..... 119/867; 294/1.3
(58) Field of Search ..... 119/867, 161; 294/1.3, 1.4, 1.5; 604/385.09

(56) References Cited

U.S. PATENT DOCUMENTS

| | | | | | |
|---|---|---|---|---|---|
| 3,804,448 | A | * | 4/1974 | Schmieler | 294/1.4 |
| 3,986,744 | A | | 10/1976 | Krogstad et al. | |
| 4,146,260 | A | | 3/1979 | Carrington | |
| 4,316,627 | A | | 2/1982 | Solpa | |
| 4,878,703 | A | * | 11/1989 | Yoshioka | 294/1.5 |
| 4,948,266 | A | * | 8/1990 | Bencic | 383/34 |
| 5,174,620 | A | * | 12/1992 | Huegelmeyer et al. | 294/1.3 |
| D334,638 | S | * | 4/1993 | Blackman | D30/162 |
| D338,888 | S | | 8/1993 | Kaneko | |
| 5,335,952 | A | | 8/1994 | Clapper | |
| 5,540,469 | A | * | 7/1996 | Albert | 294/1.4 |
| 5,628,537 | A | | 5/1997 | Kiemer | |
| 5,682,063 | A | * | 10/1997 | Yamamoto et al. | 257/700 |
| 5,868,447 | A | | 2/1999 | Clark et al. | |
| 6,086,123 | A | * | 7/2000 | Sowinski et al. | 294/1.3 |
| 6,196,600 | B1 | | 3/2001 | Miller | |
| 6,527,320 | B1 | * | 3/2003 | Gregg | 294/1.3 |
| 6,637,791 | B1 | * | 10/2003 | Steadman | 294/1.3 |
| 2004/0119304 | A1 | * | 6/2004 | Iso et al. | 294/1.3 |
| 2004/0123812 | A1 | * | 7/2004 | Condon | 119/867 |
| 2004/0189026 | A1 | * | 9/2004 | Denham et al. | 294/1.3 |

* cited by examiner

*Primary Examiner*—Yvonne R. Abbott

(57) ABSTRACT

An animal feces collection device includes a tube having distal and proximal end portions defining a path therebetween, a flap coupled to the proximal end portion, a mechanism for pivoting the flap between open and closed positions and a scooping section for collecting animal feces. The pivoting mechanism preferably includes a push button and an elongated arm pivotally connected to the flap and the lower portion of the push button. The scooping section is secured to the proximal end portion of the tube for directing feces rearwardly therethrough when the flap is raised to an open position. The device further includes a reservoir for receiving and storing collected feces and a mechanism for removably attaching the reservoir to the tube.

18 Claims, 3 Drawing Sheets

ANIMAL FECES COLLECTION DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to waste disposal devices and, more particularly, to a hand-operable feces collection device having a removable reservoir.

2. Prior Art

Many human activities generate debris and waste of a wide variety of kind. The management of waste through collection and disposal has increasingly become of concern to many cultures not only from a standpoint of living condition esthetics, but more importantly for hygienic reasons.

Not only is the disposal of waste generated by humans of concern to the hygienic environment, but also the collection and removal of animal refuse, particularly that refuse generated by pets. For example, dogs and cats are common domestic companions of many persons; removal of these animals' fecal material is necessary for a sanitary environment. Such fecal material may be deposited by the pet in both designated toilet areas for the animal and in more public areas when the animal is either allowed to roam free or is walked by its owners.

Indeed, many communities have enacted regulations requiring pet owners to collect the fecal material from their animals when the animals are taken on ambulatory excursions so that the unsanitary fecal material is removed from the public areas. Deposit of such fecal material occurs, naturally, since the animals are relatively uninhibited by their toilet habits in public places.

The collection and disposal of animal refuse is also of concern in private dwellings. Should the animal utilize a private lawn or even a designated "run" as a toilet location, the presence of the fecal material creates a non-hygienic situation, especially should those areas be used as play areas for children. Should the fecal material reside in such areas even for a short duration, such presence attracts undesired insects, such as flies and the like which further exacerbates the unsanitary conditions. Indeed, the fecal material itself can pose a problem should parasites be present therein.

For these reasons, sanitary conditions demand that fecal material be regularly removed from the animal's toilet area. This is true whether the toilet area is in a designated area, such as a dog run or cat litter box, or whether the area is an open area such as a lawn, sidewalk, pathway, etc.

Many people find the collection of animal excrement to be unpleasant and, if undertaken improperly, such collection can be unhealthy. Accordingly, many persons resort either to protective gloves while collecting fecal material or to the use of implements to accomplish this task. In the case of cat lifter, many persons employ a slotted scoop which allows the user to remove fecal material from the litter box while the particular litter falls through the slots in the scoop for reuse. Other persons employ such items as dust pans or other implements to clean up after their dogs, for example, when the dogs defecate in public or on private areas.

Considering the magnitude of this problem, it is surprising that there are few commercial products currently available for the efficacious removal of animal refuse. Accordingly, there has been a significant and long felt need for improved devices that provide a sanitary solution to this problem. There has been a further need for such devices that reduce the unpleasantness of this necessary task.

BRIEF SUMMARY OF THE INVENTION

In view of the foregoing background, it is therefore an object of the present invention to provide a device for collecting animal feces. These and other objects, features, and advantages of the invention are provided by a device including a tube having a centrally disposed longitudinal axis and distal and proximal end portions defining a path therebetween. The tube further has a slot formed therein, extending substantially parallel to the axis and along a partial length thereof. The tube includes a flap coupled to the proximal end portion.

The device further includes a handle disposed generally medially of the tube and for being grasped by a user. The slot is formed substantially medially between the handle and the proximal end portion of the tube. The device further includes a mechanism for pivoting the flap between open and closed positions and a scooping section for collecting animal feces from a select surface. The scooping section is secured to the proximal end portion of the tube for directing feces rearwardly therethrough when the flap is raised to an open position.

The scooping section preferably has a generally triangular base having at least two sidewalls integral therewith and extending vertically therefrom for preventing collected feces from falling off the base. The base further has a front portion extending obliquely and downwardly away therefrom for assisting a user to remove animal feces from a select surface and direct the feces rearwardly towards the flap.

The device further includes a reservoir for receiving and storing collected feces. The reservoir is contiguous with the distal end portion of the tube and is oppositely spaced from the scooping section along the axis. The device further includes a mechanism for removably attaching the reservoir to the tube. The attaching mechanism preferably includes a rubber band or other well know fastening members suitable for its application.

The handle includes a light source for providing illumination at night and a power source is electrically connected to the light source. The handle further includes a switch for selectively toggling the light source between on and off positions.

The pivoting mechanism includes a push button having integral upper and lower portions. The lower portion is slidably engaged with the slot. The upper portion is integral with the lower portion and protrudes upwardly and away therefrom for assisting a user in selectively moving the push button between forward and rearward positions along the slot.

The pivoting mechanism further includes an elongated arm having opposed end portions pivotally connected to the flap and the lower portion of the push button. The arm cooperates with the push button for moving the flap between open and closed positions when a user selectively moves the push button between forward and rearward positions respectively.

The device further includes a protrusion secured to the exterior surface of the tube. The protrusion has a generally rectangular shape and further has an aperture formed substantially centrally therein for receiving and securing a leash thereto.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
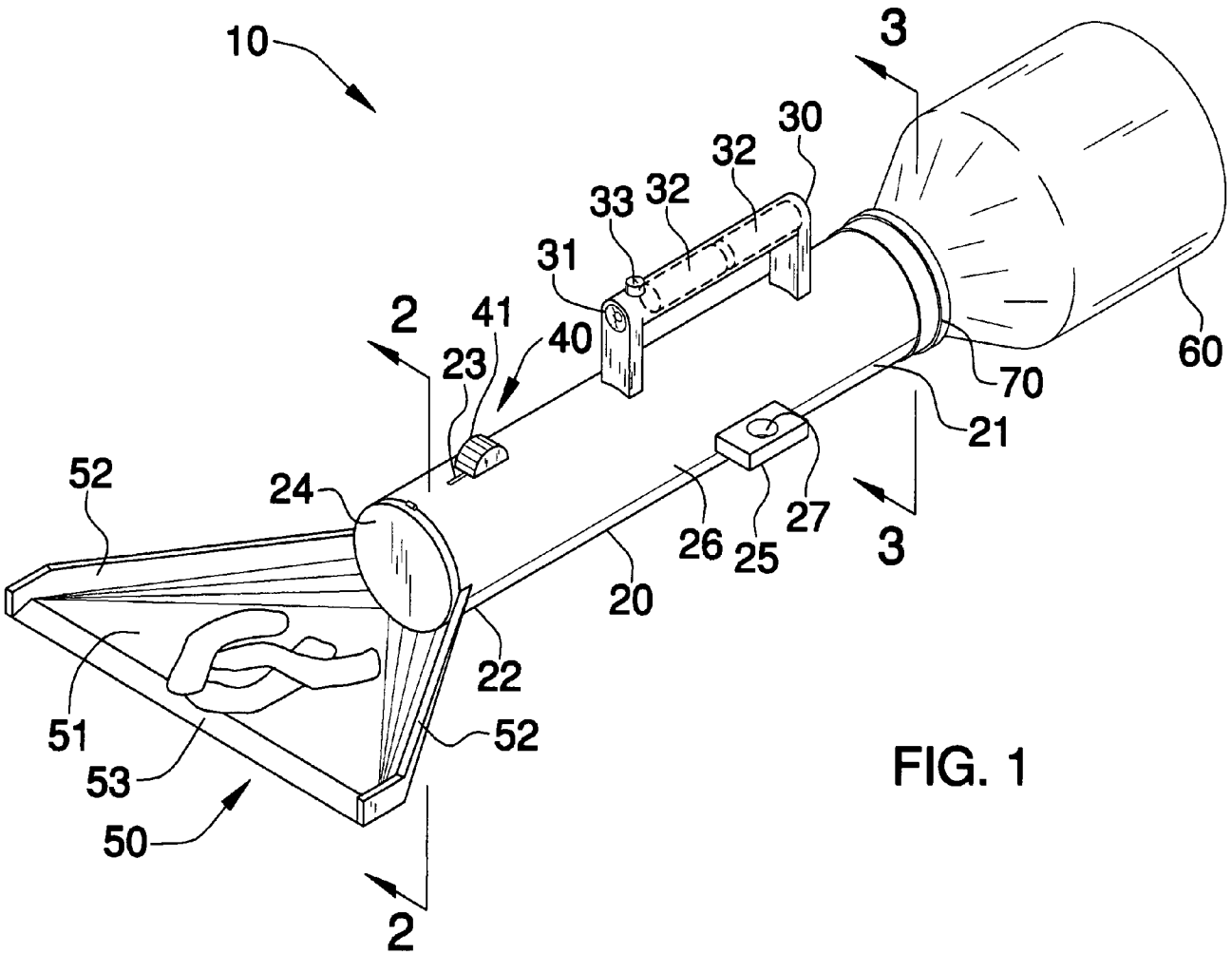
FIG. 1 is a perspective view showing an animal feces collection device, in accordance with the present invention.
Figure 2:
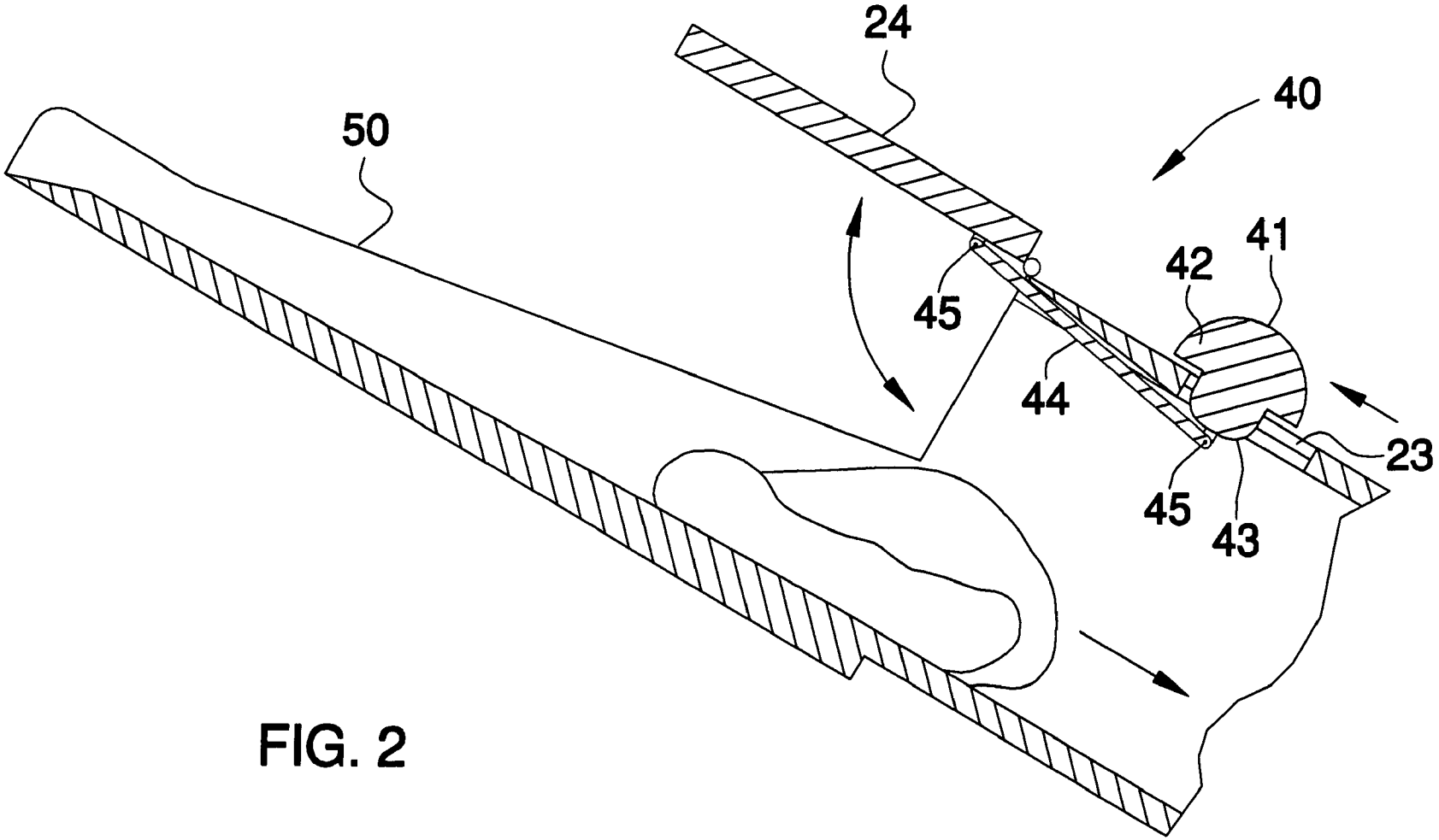
FIG. 2 is an enlarged cross-sectional view of the pivoting mechanism and scooping section, taken along line 2—2.
Figure 3:
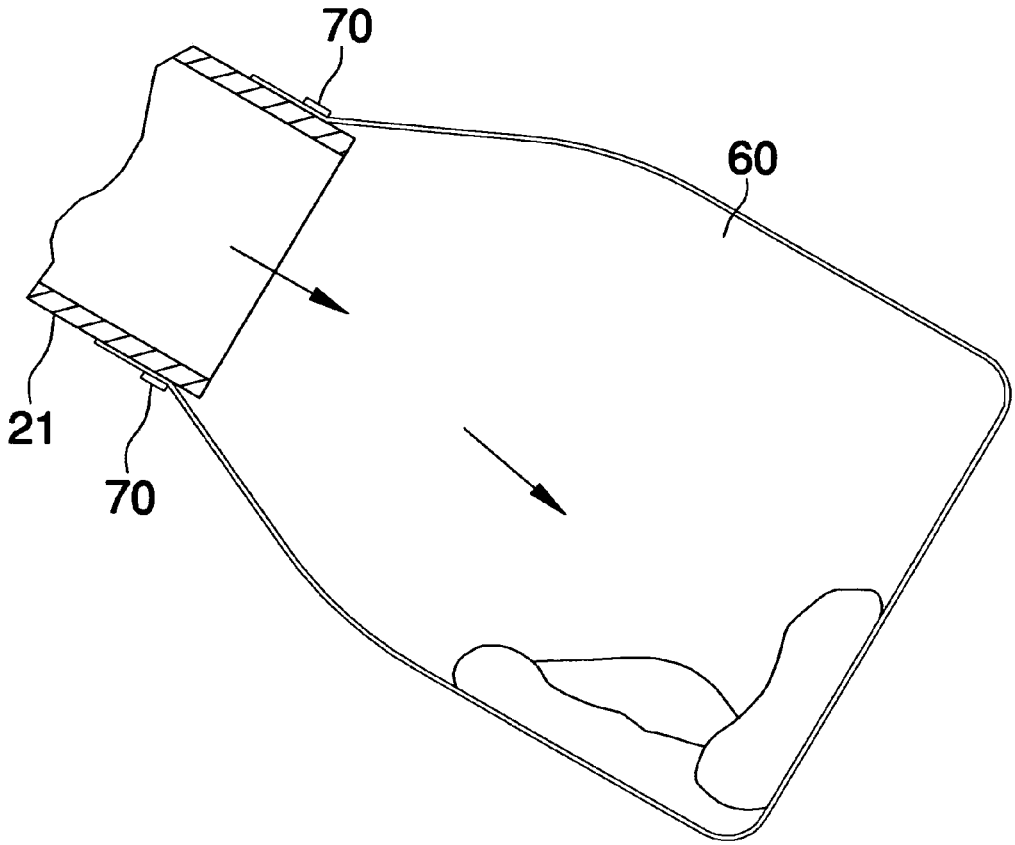
FIG. 3 is an enlarged cross-sectional view of the reservoir, taken along line 3—3.
Figure 4:
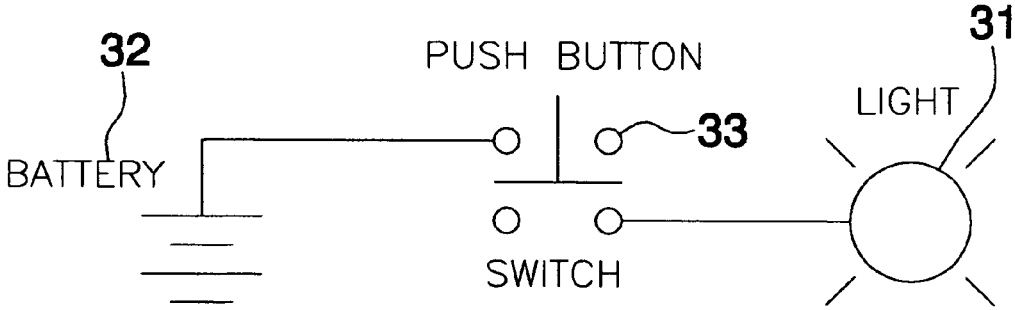
FIG. 4 is a schematic diagram of the power source, light source and switch.

The apparatus of this invention is referred to generally in FIGS. 1–4 by the reference numeral 10 and is intended to provide an animal feces collection device. It should be understood that the device 10 may be used to collect the feces of many different animals, and should not be limited to only dogs and cats.

The device 10 includes a tube 20 having a centrally disposed longitudinal axis (not shown) and distal 21 and proximal 22 end portions defining a path therebetween. The tube 20 further has a slot 23 formed therein, extending substantially parallel to the axis and along a partial length thereof. The tube 20 includes a flap 24 coupled to the proximal end portion 22.

The device 10 further includes a handle 30 disposed generally medially of the tube and for being grasped by a user. The slot 23 is formed substantially medially between the handle 30 and the proximal end portion 22 of the tube 20. The device 10 further includes a mechanism 40 for pivoting the flap 24 between open and closed positions and a scooping section 50 for collecting animal feces from a select surface. The scooping section 50 is secured to the proximal end portion 22 of the tube 20 or directing feces rearwardly therethrough when the flap 24 is raised to an open position. This enables a user to direct collected feces through the tube 20 without having to physically touch the feces, thereby eliminating any associated health risk.

The scooping section 50 has a generally triangular base 51 having at least two sidewalls 52 integral therewith and extending vertically therefrom for preventing collected feces from falling off the base 50. The base 50 further has a front portion 53 extending obliquely and downwardly away therefrom for assisting a user to remove animal feces from a select surface and direct the feces rearwardly towards the flap 24.

The device 10 further includes a reservoir 60 for receiving and storing collected feces. The reservoir 60 is contiguous with the distal end portion 21 of the tube 20 and is oppositely spaced from the scooping section 50 along the axis. The device 10 further includes a mechanism 70 for removably attaching the reservoir 60 to the tube 20. The attaching mechanism 70 preferably includes a rubber band. Once collection of the feces is completed, a user simply detaches the reservoir 70 and disposes of it. Of course, various conventional fastening members may be employed without departing from the true scope of the invention.

The handle 30 includes a light source 31 for providing illumination at night and a power source 32 electrically connected to the light source 31. The handle 30 further includes a switch 33 for selectively toggling the light source 31 between on and off positions. Many pet owners walk their pets at night shortly before bedtime so that the animal does not need to wake its owner up in the middle of the night to relieve themselves. The light source 31 enables a user to better locate and pick-up fecal material deposited by a pet at night.

The pivoting mechanism 40 includes a push button 41 having integral upper 42 and lower 43 portions. The lower portion 42 is slidably engaged with the slot 23. The upper portion 42 is integral with the lower portion 43 and protrudes upwardly and away therefrom for assisting a user in selectively moving the push button 41 between forward and rearward positions along the slot 23.

The pivoting mechanism 40 further includes an elongated arm 44 having opposed end portions 45 pivotally connected to the flap 24 and the lower portion 43 of the push button 41. The arm 44 cooperates with the push button 41 for moving the flap 24 between open and closed positions when a user selectively moves the push button 41 between forward and rearward positions respectively. The device 10 further includes a protrusion 25 secured to the exterior surface 26 of the tube 20. The protrusion 25 has a generally rectangular shape and further has an aperture 27 formed substantially centrally therein for receiving and securing a leash thereto. This enables a user to keep one hand free while walking a pet by attaching the pet's leash to the protrusion 25.

The device 10 fulfills a need for a waste disposal unit that is portable, easy to use, and provides a sanitary means of dealing with pet waste. The device 10 is convenient and effective in keeping a community clean. The simple design of the device 10 makes it durable, lightweight, and easy to handle and clean. The device 10 further enables a pet owner to abide by local laws established regarding the disposal of pet litter. When using the device 10, the pet owner does not have to touch or manipulate the waste, and it is totally contained within the reservoir 70 until it is disposed.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. An animal feces collection device, said device comprising:

a tube having a centrally disposed longitudinal axis and distal and proximal end portions defining a path therebetween, said tube further having a slot formed therein, said slot extending substantially parallel to the axis and extending along a partial length thereof, said tube comprising a flap coupled to said proximal end portion;

a handle disposed generally medially of said tube and for being grasped by a user;

means for pivoting said tube between open and closed positions;

a scooping section for collecting animal feces from a select surface, said scooping section being secured to said proximal end portion of said tube and for directing feces rearwardly therethrough when said flap is raised to an open position;

a reservoir for receiving and storing collected feces, said reservoir being contiguous with said distal end portion of said tube and being spaced from said scooping section along the axis; and means for removably attaching said reservoir to said tube.

2. The device of claim 1, wherein said handle comprises:

a light source for providing illumination at night;

a power source electrically connected to said light source; and a switch for selectively toggling said light source between on and off positions.

3. The device of claim 1, wherein said slot is formed substantially medially between said handle and said proximal end portion of said tube.

4. The device of claim 1, wherein said pivoting means comprises:

a push button having integral upper and lower portions, said lower portion being slidably engaged with said slot, said upper portion being integral with said lower portion and protruding upwardly and away therefrom for assisting a user in selectively moving said push button between forward and rearward positions along said slot; and an elongated arm having opposed end portions pivotally connected to said flap and said lower portion of said push button, said arm cooperating with said push button for moving said flap between open and closed positions when a user selectively moves said push button between forward and rearward positions respectively.

5. The device of claim 1, wherein said attaching means comprises a rubber band.

6. The device of claim 1, further comprising: a protrusion secured to the exterior surface of said tube, said protrusion having a generally rectangular shape and further having an aperture formed substantially centrally therein for receiving and securing a leash thereto.

7. The device of claim 1, wherein said scooping section has a generally triangular base having at least two sidewalls integral therewith and extending vertically therefrom for preventing feces from falling off said base, said base further having a front portion extending obliquely and downwardly away therefrom for assisting a user to remove animal feces from a select surface and direct the feces rearwardly towards said flap.

8. An animal feces collection device, said device comprising:

a tube having a centrally disposed longitudinal axis and distal and proximal end portions defining a path therebetween, said tube further having a slot formed therein, said slot extending substantially parallel to the axis and extending along a partial length thereof, said tube comprising a flap coupled to said proximal end portion;

a handle disposed generally medially of said tube and for being grasped by a user;

means for pivoting said tube between open and closed positions;

a scooping section for collecting animal feces from a select surface, said scooping section being secured to said proximal end portion of said tube and for directing feces rearwardly therethrough when said flap is raised to an open position;

a reservoir for receiving and storing collected feces, said reservoir being contiguous with said distal end portion of said tube and being spaced from said scooping section along the axis;

means for removably attaching said reservoir to said tube; and a protrusion secured to the exterior surface of said tube, said protrusion having a generally rectangular shape and further having an aperture formed substantially centrally therein for receiving and securing a leash thereto.

9. The device of claim 8, wherein said handle comprises:

a light source for providing illumination at night;

a power source electrically connected to said light source; and a switch for selectively toggling said light source between on and off positions.

10. The device of claim 8, wherein said slot is formed substantially medially between said handle and said proximal end portion of said tube.

11. The device of claim 8, wherein said pivoting means comprises:

a push button having integral upper and lower portions, said lower portion being slidably engaged with said slot, said upper portion being integral with said lower portion and protruding upwardly and away therefrom for assisting a user in selectively moving said push button between forward and rearward positions along said slot; and an elongated arm having opposed end portions pivotally connected to said flap and said lower portion of said push button, said arm cooperating with said push button for moving said flap between open and closed positions when a user selectively moves said push button between forward and rearward positions respectively.

12. The device of claim 8, wherein said attaching means comprises a rubber band.

13. The device of claim 8, wherein said scooping section has a generally triangular base having at least two sidewalls integral therewith and extending vertically therefrom for preventing feces from falling off said base, said base further having a front portion extending obliquely and downwardly away therefrom for assisting a user to remove animal feces from a select surface and direct the feces rearwardly towards said flap.

14. An animal feces collection device, said device comprising:

a tube having a centrally disposed longitudinal axis and distal and proximal end portions defining a path therebetween, said tube further having a slot formed therein, said slot extending substantially parallel to the axis and extending along a partial length thereof, said tube comprising a flap coupled to said proximal end portion;

a handle disposed generally medially of said tube and for being grasped by a user;

means for pivoting said tube between open and closed positions;

a scooping section for collecting animal feces from a select surface, said scooping section being secured to said proximal end portion of said tube and for directing feces rearwardly therethrough when said flap is raised to an open position, said scooping section having a generally triangular base having at least two sidewalls integral therewith and extending vertically therefrom for preventing feces from falling off said base, said base further having a front portion extending obliquely and downwardly away therefrom for assisting a user to remove animal feces from a select surface and direct the feces rearwardly towards said flap, a reservoir for receiving and storing collected feces, said reservoir being contiguous with said distal end portion of said tube and being spaced from said scooping section along the axis;

means for removably attaching said reservoir to said tube; and a protrusion secured to the exterior surface of said tube, said protrusion having a generally rectangular shape and further having an aperture formed substantially centrally therein for receiving and securing a leash thereto.

15. The device of claim 14, wherein said handle comprises:

a light source for providing illumination at night;

a power source electrically connected to said light source; and a switch for selectively toggling said light source between on and off positions.

16. The device of claim 14, wherein said slot is formed substantially medially between said handle and said proximal end portion of said tube.

17. The device of claim 14, wherein said pivoting means comprises:

a push button having integral upper and lower portions, said lower portion being slidably engaged with said slot, said upper portion being integral with said lower portion and protruding upwardly and away therefrom for assisting a user in selectively moving said push button between forward and rearward positions along said slot; and an elongated arm having opposed end portions pivotally connected to said flap and said lower portion of said push button, said arm cooperating with said push button for moving said flap between open and closed positions when a user selectively moves said push button between forward and rearward positions respectively.

18. The device of claim 14, wherein said attaching means comprises a rubber band.

* * * * *